US005800042A

United States Patent [19]

Blank

[11] Patent Number: 5,800,042

[45] Date of Patent: Sep. 1, 1998

[54] ADJUSTABLE HEADLAMP SYSTEM

[76] Inventor: Stephen E. Blank, 205 Churchtown Rd., Narvon, Pa. 17555

[21] Appl. No.: 723,391

[22] Filed: Sep. 30, 1996

[51] Int. Cl.[6] ..... F21L 15/14

[52] U.S. Cl. ..... 362/105; 362/103; 362/191

[58] Field of Search ..... 362/103, 105, 362/106, 191; 2/209.13

[56] References Cited

U.S. PATENT DOCUMENTS

| | | | |
|---|---|---|---|
| 1,559,191 | 10/1925 | Smith | 362/105 |
| 1,559,451 | 10/1925 | Parker | 362/106 |
| 1,584,276 | 5/1926 | Coulter | 362/105 |
| 3,069,538 | 12/1962 | Hobson | 362/105 |
| 3,250,909 | 5/1966 | Oldenburger | 362/105 |
| 4,631,644 | 12/1986 | Dannhauer | 362/105 |
| 5,115,382 | 5/1992 | Smith | 362/105 |
| 5,667,292 | 9/1997 | Sabalvaro, Jr. | 362/106 |

FOREIGN PATENT DOCUMENTS

| | | | |
|---|---|---|---|
| 369448 | 3/1932 | United Kingdom | 362/105 |

*Primary Examiner*—Alan Cariaso

[57] ABSTRACT

A new Adjustable Headlamp System for providing high quality lighting for the user allowing the user to utilize both hands, where the present invention has no electrical connections considering of a solder base. The inventive device includes an adjustable head band which engages the exterior portion of the user's head, a headlamp assembly mounted to the frontal portion of the adjustable head band, a high intensity headlamp pivotally mounted to headlamp assembly, an electrical connector means mounted to the headlamp assembly where the electrical connector means is electrically connected to the high intensity headlamp and has no soldered connections, and a battery holder electrically connected to the electronic connector means without any soldered connections.

12 Claims, 3 Drawing Sheets

ADJUSTABLE HEADLAMP SYSTEM

BACKGROUND OF THE INVENTION

1. Field of the Invention

The present invention relates to Headlamp Devices and more particularly pertains to a new Adjustable Headlamp System for providing high quality lighting for the user allowing the user to utilize both hands, where the present invention has no electrical connections considering of a solder base.

2. Description of the Prior Art

The use of Headlamp Devices is known in the prior art. More specifically, Headlamp Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Headlamp Devices include U.S. Pat. Nos. 5,115,382; 4,631,645; U.S. Design Pat. No. 274,758; U.S. Pat. Nos. 4,794,496; 4,631,644 and 4,429,351.

While these devices fulfill their respective, particular objectives and requirements, the aforementioned patents do not disclose a new Adjustable Headlamp System. The inventive device includes an adjustable head band which engages the exterior portion of the user's head, a headlamp assembly mounted to the frontal portion of the adjustable head band, a high intensity headlamp pivotally mounted to headlamp assembly, an electrical connector means mounted to the headlamp assembly where the electrical connector means is electrically connected to the high intensity headlamp and has no soldered connections, and a battery holder electrically connected to the electronic connector means without any soldered connections.

In these respects, the Adjustable Headlamp System according to the present invention substantially departs from the conventional concepts and designs of the prior art, and in so doing provides an apparatus primarily developed for the purpose of providing high quality lighting for the user allowing the user to utilize both hands, where the present invention has no electrical connections considering of a solder base.

SUMMARY OF THE INVENTION

In view of the foregoing disadvantages inherent in the known types of Headlamp Devices now present in the prior art, the present invention provides a new Adjustable Headlamp System construction wherein the same can be utilized for providing high quality lighting for the user allowing the user to utilize both hands, where the present invention has no electrical connections considering of a solder base.

The general purpose of the present invention, which will be described subsequently in greater detail, is to provide a new Adjustable Headlamp System apparatus and method which has many of the advantages of the Headlamp Devices mentioned heretofore and many novel features that result in a new Adjustable Headlamp System which is not anticipated, rendered obvious, suggested, or even implied by any of the prior art Headlamp Devices, either alone or in any combination thereof.

To attain this, the present invention generally comprises an adjustable head band which engages the exterior portion of the user's head, a headlamp assembly mounted to the frontal portion of the adjustable head band, a high intensity headlamp pivotally mounted to headlamp assembly, an electrical connector means mounted to the headlamp assembly where the electrical connector means is electrically connected to the high intensity headlamp and has no soldered connections, and a battery holder electrically connected to the electronic connector means without any soldered connections.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Adjustable Headlamp System apparatus and method which has many of the advantages of the Headlamp Devices mentioned heretofore and many novel features that result in a new Adjustable Headlamp System which is not anticipated, rendered obvious, suggested, or even implied by any of the prior art Headlamp Devices, either alone or in any combination thereof.

It is another object of the present invention to provide a new Adjustable Headlamp System which may be easily and efficiently manufactured and marketed.

It is a further object of the present invention to provide a new Adjustable Headlamp System which is of a durable and reliable construction.

An even further object of the present invention is to provide a new Adjustable Headlamp System which is susceptible of a low cost of manufacture with regard to both materials and labor, and which accordingly is then susceptible of low prices of sale to the consuming public, thereby making such Adjustable Headlamp System economically available to the buying public.

Still yet another object of the present invention is to provide a new Adjustable Headlamp System which provides in the apparatuses and methods of the prior art some of the advantages thereof, while simultaneously overcoming some of the disadvantages normally associated therewith.

Still another object of the present invention is to provide a new Adjustable Headlamp System for providing high quality lighting for the user allowing the user to utilize both hands, where the present invention has no electrical connections considering of a solder base.

Yet another object of the present invention is to provide a new Adjustable Headlamp System which includes an adjustable head band which engages the exterior portion of the user's head, a headlamp assembly mounted to the frontal portion of the adjustable head band, a high intensity headlamp pivotally mounted to headlamp assembly, an electrical connector means mounted to the headlamp assembly where the electrical connector means is electrically connected to the high intensity headlamp and has no soldered connections, and a battery holder electrically connected to the electronic connector means without any soldered connections.

Still yet another object of the present invention is to provide a new Adjustable Headlamp System where all the electrical connections are replaceable.

Even still another object of the present invention is to provide a new Adjustable Headlamp System that allows the user to focus the beam of light to a specific or broad area.

Still another object of the present invention is to provide a new Adjustable Headlamp System where all the wires are easily reestablished if they should break.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
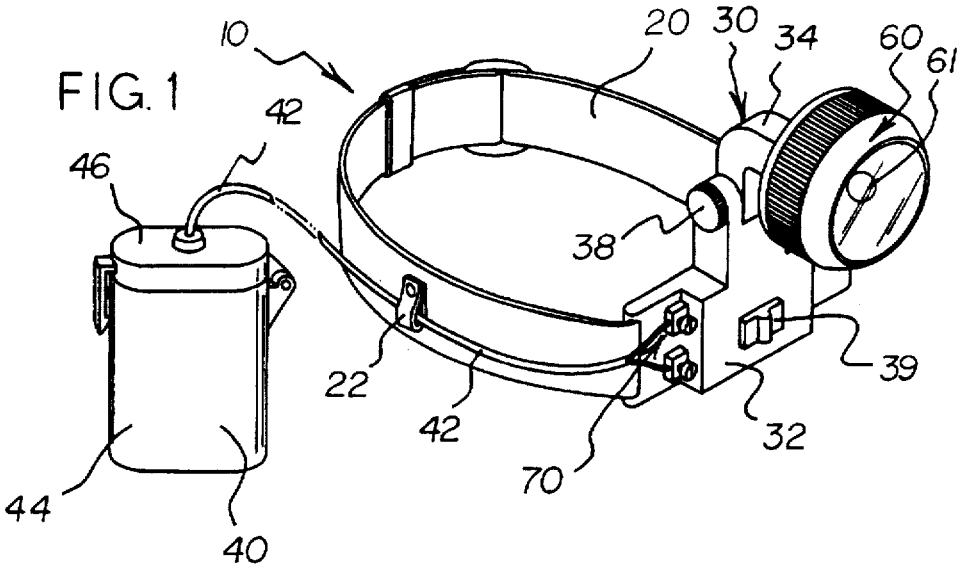
FIG. 1 is a side perspective view of a new Adjustable Headlamp System according to the present invention.

With reference now to the drawings, and in particular to FIGS. 1 through 6 thereof, a new Adjustable Headlamp System embodying the principles and concepts of the present invention and generally designated by the reference numeral 10 will be described.

More specifically, it will be noted that the Adjustable Headlamp System 10 comprises an adjustable head band 20 positionable around a person's head, a headlamp assembly 30 secured to the frontal portion of the adjustable head band 20, a high intensity headlamp 60 pivotally secured to the upper portion of the headlamp assembly 30, an electrical connector means 70 secured to the lower portion of the headlamp assembly 30 and electrically connected to the high intensity headlamp 60, and a battery holder 40 electrically connected to the electrically connector means.

Figure 2:
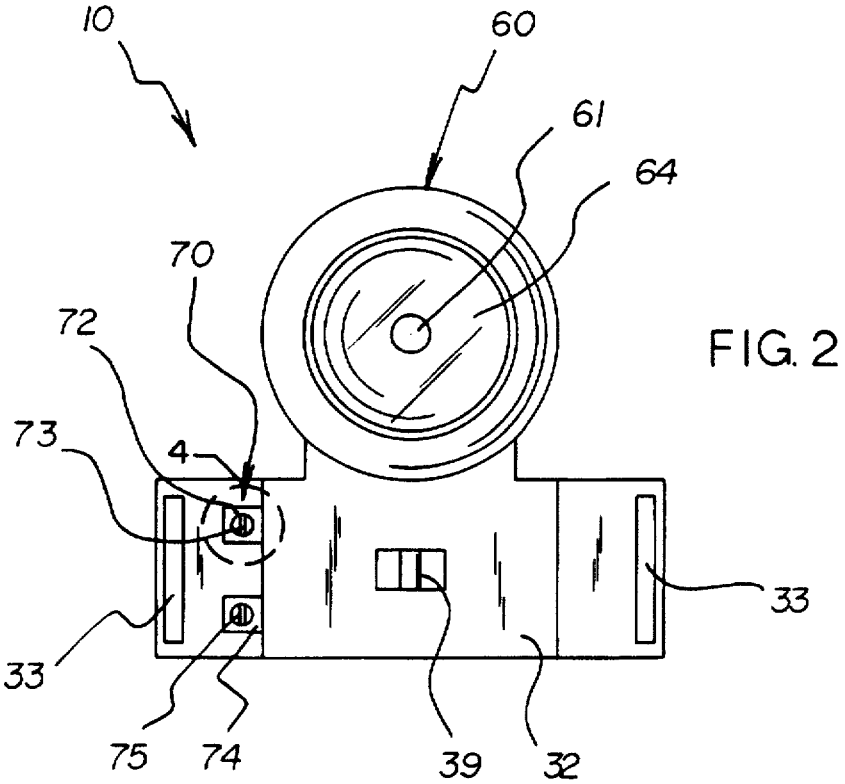
FIG. 2 is a front view thereof.
Figure 3:
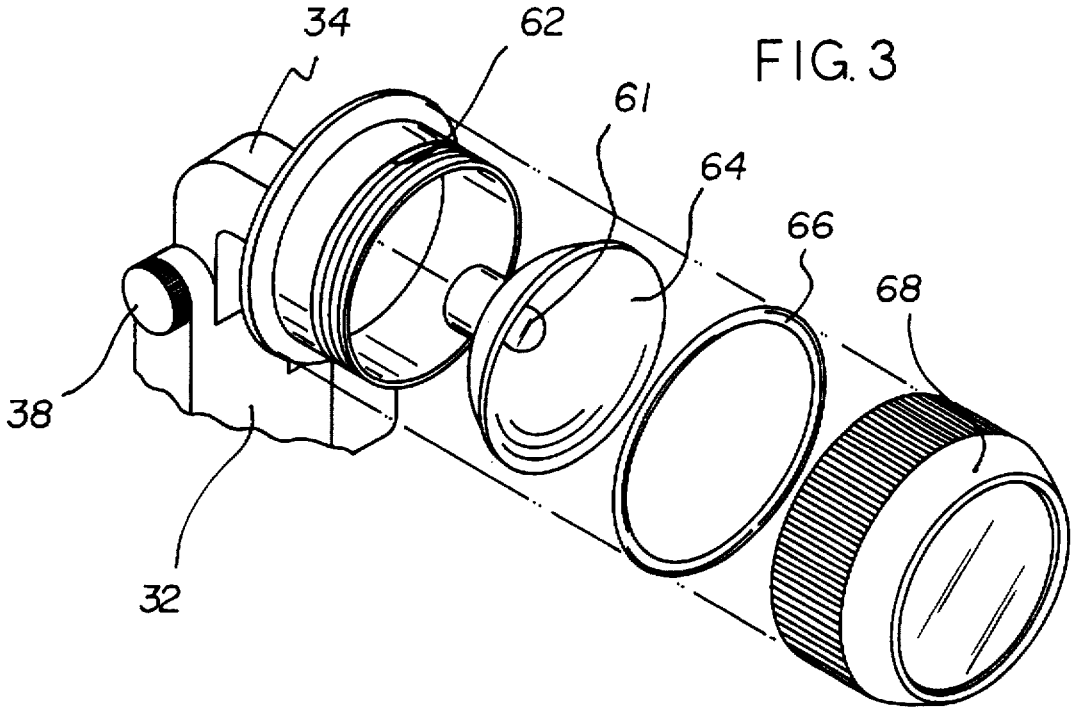
FIG. 3 is an exploded isometric illustration of the present invention.
Figure 4:
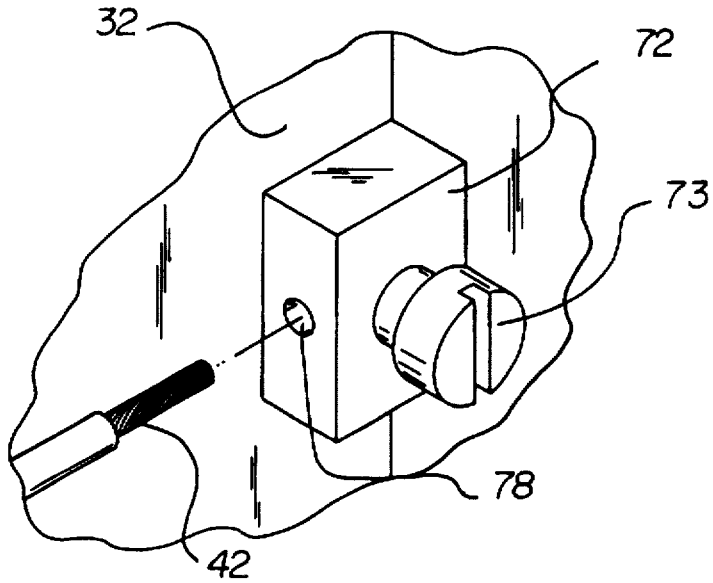
FIG. 4 is a magnified view of the electrical connector means.
Figure 5:
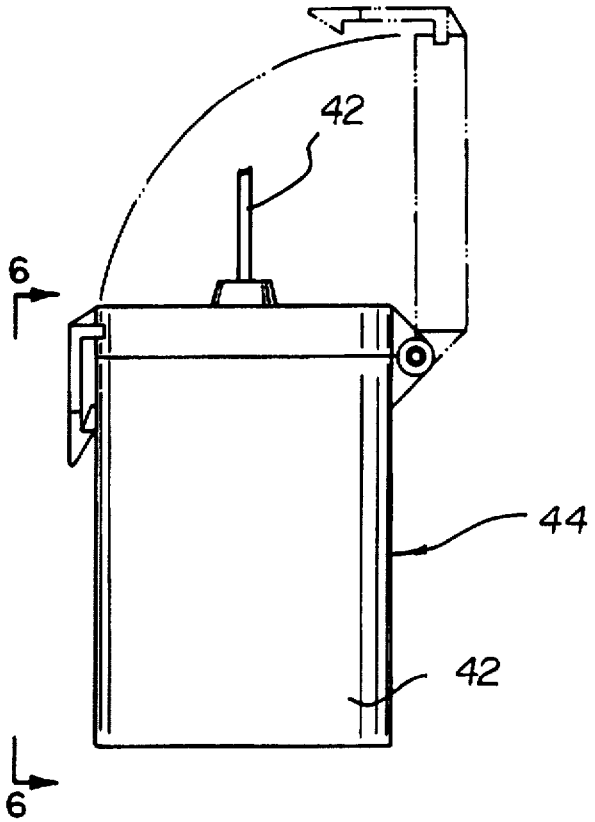
FIG. 5 is a magnified view of the battery holder.
Figure 6:
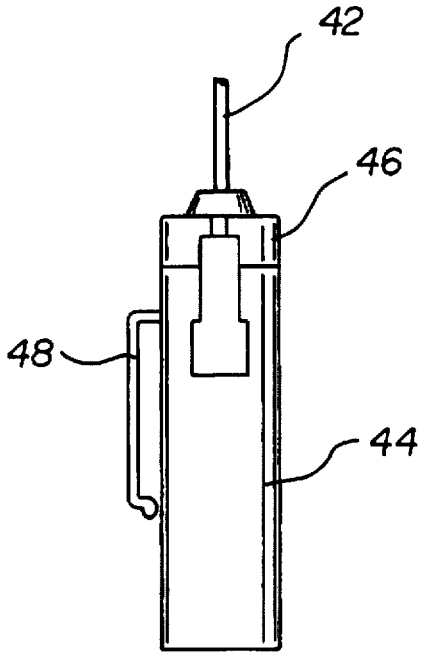
FIG. 6 is a cross sectional view taken along line 6—6 of FIG. 5.

As best illustrated in FIGS. 1–2, it can be shown that the headlamp assembly 30 includes an inverted T-shaped housing 32 including a pair of strap slots 33 within the lower portion. The adjustable head band 20 projects through said strap slots 33 supporting the inverted T-shaped housing 32 substantially parallel to the exterior surface of the adjustable head band 20. An L-shaped arm 34 is pivotally attached to the upper portion of the inverted T-shaped housing 32 by a tightening member 38, where the L-shaped arm 34 pivots vertically as best disclosed in FIG. 3 of the drawings. The battery holder 40 includes a holding body 44 formed to hold an unnumbered conventional battery as shown in FIG. 5–6. A latching lid 46 is pivotally mounted to the unnumbered upper lip of the holding body 44 enclosing the holding body 44 when closed. A belt clip 48 is secured to the side portion of the holding body 44 allowing fastening of the battery holder 40 to an unnumbered conventional belt as best disclosed in FIG. 6 of the drawings. A replaceable supply wire 42 is electronically connected to the unnumbered conventional battery at one end and is electronically connected to the electrical connector means 70 at the opposite end. The replaceable supply wire 42 is positioned near the adjustable head band 20 by a wire harness 22 secured to the side portion of the adjustable head band 20 as best disclosed in FIG. 1 of the drawings. As best shown in FIG. 3 of the drawings, the high intensity headlamp 60 includes a hollow cylindrical cover 62 secured to the end of the L-shaped arm 34 opposite of the inverted T-shaped housing 32. A conical arcuate reflector 64 is removably secured centrally within the hollow cylindrical cover 62. A high intensity bulb 61 is removably secured within the central portion of the conical arcuate reflector 64. The high intensity bulb 61 is electronically connected to an electronic switch 39 and the electronic switch 39 is electronically connected to the electrical connector means 70 opposite of the high intensity bulb 61. A focusing lens cover 68 is rotatably secured to the hollow cylindrical cover 62. A rubber sealing ring 66 is positioned mesial the focusing lens cover 68 and the hollow cylindrical cover 62 thereby sealing the high intensity bulb 61 from the elements. The electrical connector means 70 includes a top rectangular connector 72 which includes a wire connecting passage 78 allowing the projection and capture of the replaceable supply wire 42 as best shown in FIG. 4 of the drawings. A top fastener 73 is removably projecting into the frontal portion of the top rectangular connector 72 with the tip engaging and securing the replaceable supply wire 42. A bottom rectangular connector 74 also includes a unnumbered wire connecting passage allowing the projection and capture of the replaceable supply wire 42. A bottom fastener 75 removably projects into the frontal portion of the bottom rectangular connector 74 with the tip engaging and securing the replaceable supply wire 42. The headlamp assembly 30 and the high intensity headlamp 60 are preferably constructed from waterproof plastic. Alternatively, the headlamp assembly 30 and the high intensity headlamp 60 would be constructed from a stainless steel metal.

In use, the user secures the adjustable head band 20 over his head. The user then closes the electronic switch 39 which facilitates a direct electrical connection between the unnumbered conventional battery and the high intensity bulb 61. Should the replaceable supply wire 42 become broken during use, the user simply removes a portion of the insulation near the end and inserts the replaceable supply wire 42 into the wire connecting passage 78 of the proper rectangular connector 72 or 74. The user then tightens the proper fastener 73 or 75 which engages and captures the replaceable supply wire 42.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the united states is as follows:

1. An adjustable headlamp system comprising:

an adjustable head band positionable around a person's head:

a headlamp assembly secured to a frontal portion of the adjustable head band;

a high intensity headlamp pivotally secured to an upper portion of the headlamp assembly;

an electrical connector means secured to a lower portion of the headlamp assembly such that the head band is positioned between the person's head and the electrical connector means, the electrical connector means further being electrically connected to the high intensity headlamp;

a battery holder electrically connected to the electrical connector means;

wherein the headlamp assembly includes;

an inverted T-shaped housing including a pair of strap slots within a lower portion and where the adjustable head band projects through said strap slots supporting the inverted T-shaped housing substantially parallel to an exterior surface of the adjustable head band; and an L-shaped arm pivotally attached to an upper portion of the inverted T-shaped housing by a tightening member, where the L-shaped arm pivots vertically.

2. The adjustable headlamp system of claim 1, wherein the battery holder includes:

a holding body formed to hold a conventional battery;

a latching lid which is pivotally mounted to an upper lip of the holding body enclosing the holding body when closed;

a belt clip secured to a side portion of the holding body allowing fastening of the battery holder to a conventional belt; and a replaceable supply wire electronically connected to the conventional battery at one end and electronically connected to the electrical connector means at the opposite end, where the replaceable supply wire is positioned near the adjustable head band by a wire harness secured to a side portion of the adjustable head band.

3. An adjustable headlamp system comprising:

an adjustable head band positionable around a person's head;

a headlamp assembly secured to a frontal portion of the adjustable head band;

a high intensity headlamp pivotally secured to an upper portion of the headlamp assembly;

an electrical connector means secured to a lower portion of the headlamp assembly and electrically connected to the high intensity headlamp;

a battery holder electrically connected to the electrical connector means;

wherein the headlamp assembly includes an inverted T-shaped housing including a pair of strap slots within a lower portion and where the adjustable head band projects through said strap slots supporting the inverted T-shaped housing substantially parallel to an exterior surface of the adjustable head band; and an L-shaped arm pivotally attached to an upper portion of the inverted T-shaped housing by a tightening member, where the L-shaped arm pivots vertically;

wherein the battery holder includes:

a holding body formed to hold a conventional battery;

a latching lid which is pivotally mounted to an upper lip of the holding body enclosing the holding body when closed;

a belt clip secured to a side portion of the holding body allowing fastening of the battery holder to a conventional belt; and a replaceable supply wire electronically connected to the conventional battery at one end and electronically connected to the electrical connector means at the opposite end, where the replaceable supply wire is positioned near the adjustable head band by a wire harness secured to a side portion of the adjustable head band; and wherein the high intensity headlamp includes a hollow cylindrical cover secured to an end of the L-shaped arm opposite of the inverted T-shaped housing;

a conical arcuate reflector removably secured centrally within the hollow cylindrical cover;

a high intensity bulb removably secured within a central portion of the conical arcuate reflector, where the high intensity bulb is electronically connected to an electronic switch and where the electronic switch is electronically connected to the electrical connector means opposite of the high intensity bulb; and a focusing lens cover rotatably secured to the hollow cylindrical cover, where a rubber sealing ring is between the focusing lens cover and the hollow cylindrical cover sealing the high intensity bulb from the elements.

4. The adjustable headlamp system of claim 3, wherein the electrical connector means includes:

a top rectangular connector which includes a wire connecting passage allowing the projection and capture of the replaceable supply wire;

a top fastener removably projecting into a frontal portion of the top rectangular connector with a tip of the top rectangular connector engaging and securing the replaceable supply wire;

a bottom rectangular connector which also includes a wire connecting passage allowing the projection and capture of the replaceable supply wire; and a bottom fastener removably projecting into a frontal portion of the bottom rectangular connector with a tip of the bottom rectangular connector engaging and securing the replaceable supply wire.

5. The adjustable headlamp system of claim 4, wherein the headlamp assembly and the high intensity headlamp are constructed from waterproof plastic.

6. The adjustable headlamp system of claim 4, wherein the headlamp assembly and the high intensity headlamp are constructed from a stainless steel material.

7. The adjustable headlamp system of claim 3, wherein the headlamp assembly and the high intensity headlamp are constructed from waterproof plastic.

8. The adjustable headlamp system of claim 3, wherein the headlamp assembly and the high intensity headlamp are constructed from a stainless steel material.

9. An adjustable headlamp assembly for use while attached to a human head, the adjustable headlamp assembly comprising:

an adjustable head band adapted to fit around the human head;

a headlamp assembly secured to a frontal portion of the adjustable head band;

a high intensity headlamp pivotally secured to an upper portion of the headlamp assembly;

an electrical connector means secured to a lower portion of the headlamp assembly and electrically connected to the high intensity headlamp;

a battery holder electrically connected to the electrical connector means;

wherein the headlamp assembly includes an inverted T-shaped housing including a pair of strap slots within a lower portion and where the adjustable head band projects through said strap slots supporting the inverted T-shaped housing substantially parallel to an exterior surface of the adjustable head band; and an L-shaped arm pivotally attached to an upper portion of the inverted T-shaped housing by a tightening member, where the L-shaped arm pivots vertically; and wherein the high intensity headlamp includes a hollow cylindrical cover secured to an end of the L-shaped arm opposite of the inverted T-shaped housing;

a conical arcuate reflector removably secured centrally within the hollow cylindrical cover;

a high intensity bulb removably secured within a central portion of the conical arcuate reflector, where the high intensity bulb is electronically connected to an electronic switch and where the electronic switch is electronically connected to the electrical connector means opposite of the high intensity bulb; and a focusing lens cover rotatably secured to the hollow cylindrical cover, where a rubber sealing ring is between the focusing lens cover and the hollow cylindrical cover sealing the high intensity bulb from the elements.

10. The adjustable headlamp system of claim 9, wherein the electrical connector means includes:

a top rectangular connector which includes a wire connecting passage allowing the projection and capture of the replaceable supply wire;

a top fastener removably projecting into a frontal portion of the top rectangular connector with a tip of the top rectangular connector engaging and securing the replaceable supply wire;

a bottom rectangular connector which also includes a wire connecting passage allowing the projection and capture of the replaceable supply wire; and a bottom fastener removably projecting into a frontal portion of the bottom rectangular connector with a tip of the bottom rectangular connector engaging and securing the replaceable supply wire.

11. The adjustable headlamp system of claim 9, wherein the headlamp assembly and the high intensity headlamp are constructed from waterproof plastic.

12. The adjustable headlamp system of claim 9, wherein the headlamp assembly and the high intensity headlamp are constructed from a stainless steel material.

* * * * *